US007333069B2

(12) United States Patent
Louzir et al.

(10) Patent No.: US 7,333,069 B2
(45) Date of Patent: Feb. 19, 2008

(54) RADIATING ELEMENT DESIGNED TO OPERATE IN A SMALL ANTENNA

(75) Inventors: Ali Louzir, Rennes (FR); Franck Thudor, Rennes (FR); Jean-Luc Robert, Betton (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 11/348,205

(22) Filed: Feb. 6, 2006

(65) Prior Publication Data

US 2006/0176234 A1 Aug. 10, 2006

(30) Foreign Application Priority Data

Feb. 7, 2005 (FR) ..... 05 50347

(51) Int. Cl.
*H01Q 7/00* (2006.01)
*H01Q 11/12* (2006.01)

(52) U.S. Cl. ..... 343/866; 343/741

(58) Field of Classification Search ..... 343/700 MS, 343/741, 748, 866
See application file for complete search history.

(56) References Cited

U.S. PATENT DOCUMENTS

| | | | | |
|---|---|---|---|---|
| 1,971,303 | A * | 8/1934 | Mann | 343/872 |
| 3,231,894 | A * | 1/1966 | Nagai | 343/806 |
| 3,369,243 | A * | 2/1968 | Greiser | 343/770 |
| 3,576,566 | A * | 4/1971 | Cover et al. | 343/705 |

FOREIGN PATENT DOCUMENTS

| | | |
|---|---|---|
| GB | 2077046 | 9/1981 |
| JP | 2001298319 | 10/2001 |
| JP | 2003332820 | 11/2003 |

OTHER PUBLICATIONS

Patent Abstracts of Japan vol. 2002, No. 02, Apr. 2002 & JP 2001 298319 a (DX Antenna Co. Ltd), Oct. 26, 2001.
Patent Abstrtacts of Japan vol. 203, No. 12, Dec. 5, 2003 & JP 2003 332820 a (FEC INC), 21 Nov. 21, 2003.
Search report dated Sep. 12, 2005.

* cited by examiner

*Primary Examiner*—Shih-Chao Chen
(74) *Attorney, Agent, or Firm*—Joseph J. Laks; Robert D. Shedd; Brian J. Cromarty

(57) ABSTRACT

The present invention relates to a radiating element designed to operate in an electrically small antenna including a conducting strip folded N times like a bellows.

7 Claims, 3 Drawing Sheets

RADIATING ELEMENT DESIGNED TO OPERATE IN A SMALL ANTENNA

The present invention relates to a radiating element designed to operate in an electrically small antenna.

This application claims the benefit, under 35 U.S.C. § 119 of French Patent Application 05/50347, filed Feb. 7, 2005.

BACKGROUND OF THE INVENTION

Such electrically small antennas, that is, with a size substantially smaller than the wavelength of the signals that they receive and transmit, are particularly used in the portable reception of FM radio waves. Hence such an antenna must be able to be integrated in a unit of small dimensions to meet portability constraints.

Now, it is known that an antenna, irrespective of its type or the technology used to realise it, must have a minimum dimension in the order of the wavelength and typically greater than the quarter wavelength to be able to operate correctly.

For FM frequencies, the wavelength is in the order of 3 meters at 100 MHz, the FM radio band spreads out around this value. For example, in France, the FM band ranges from 88 MHz to 108 MHz. In order to obtain an effective reception, whip antennas are generally used on which the orientation and length is adjusted, that is typically 75 cm for a quarter wavelength at 100 MHz, for the best reception. However this type of antenna cannot be used for the portable applications. Use is therefore made of loop type antennas, which are electrically small antennas whose efficiency is generally very poor. This is expressed in the following equation:

$$\eta = \frac{R_{\text{rad}}}{R_{\text{rad}} + R_{ohm}}$$

where $R_{rad}$ is the radiation resistance and $R_{ohm}$ is the ohmic loss resistance.

To improve the efficiency, the techniques used consist of increasing the radiation resistances by increasing the volume occupied by the antenna while providing optimum coupling conditions. This is for example shown in Small Antennas, by Harold Wheeler, IEEE Trans. Ant. Propagation, Vol. AP23, July 1975. AP23, July 1975. As soon as the conducting material used for the radiating element has an acceptable conductivity and the dielectric losses are low, the ohmic loss generally remains low in relation to the radiation resistance. This is not the case when the efficiency is low, which is the case for small antennas.

BRIEF SUMMARY OF THE INVENTION

Hence, this involves proposing a radiating element that can be used in an electrically small antenna and that can obtain a correct antenna efficiency.

The present invention relates to a band type antenna, namely an electrically small antenna constituted by a conducting strip folded N times like a bellows and in the form of a loop.

It is indeed observed that for a regular folding of the conducting strip in the manner of a bellows, the efficiency is thus multiplied by N. The folding maintains the overall dimensions of the antenna at a similar size to that obtained with an antenna of the same size and realised with a standard conducting strip. The bellows folding can be rectilinear and parallel or not according to the antenna shape factor to respect depending on the volume available.

In one embodiment, the folding angle is determined so as to adjust the impedance of the radiating element.

The folding of the tape introduces a capacitive component in the antenna behaviour which, when it has small dimensions, is strongly inductive. This therefore enables the impedance to be matched.

In one embodiment, the conductive strip is a thin sheet metal strip.

In one embodiment, the conducting strip is constituted by a layer of metallization realised on one side of a substrate made of a thin plastic material.

BRIEF DESCRIPTION OF THE DRAWINGS

Other characteristics and advantages of the present invention will emerge on reading the description of different non-restrictive embodiments, the description being made with reference to the annexed drawings wherein.

DESCRIPTION OF PREFERRED EMBODIMENTS

Figure 1:
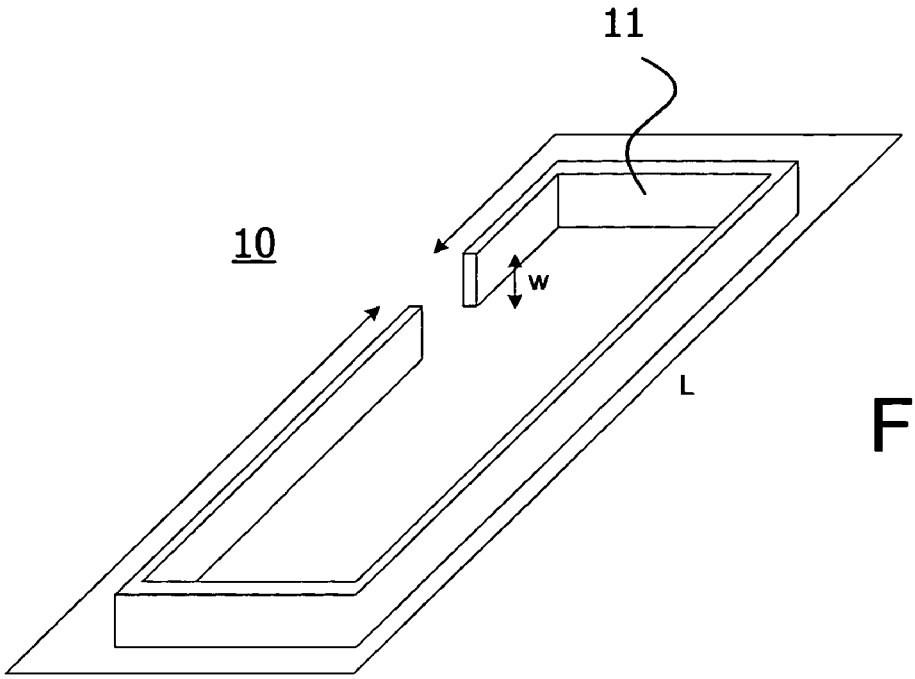
FIG. 1 shows a standard loop antenna.
Figure 2:
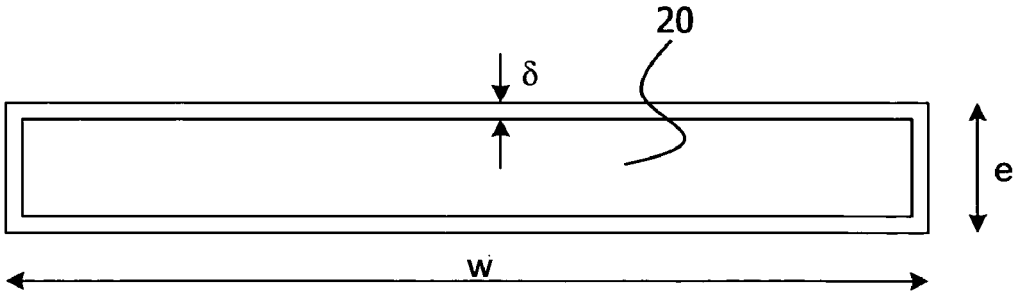
FIG. 2 shows the cross-section of a conductive strip.

FIG. 1 shows a standard loop antenna 10 of perimeter L including an radiating element 11 of length L and width w. The radiating element 11 is for example a conductive strip 20, of thickness e and width w whose cross-section is shown in FIG. 2.

Such antennas are traditionally used for the reception of FM frequencies in portable equipment. Indeed, in portable equipment, it is not possible to use antennas with a length in the order of the wavelength, which is 3 m at 100 MHz. The loop antennas are, electrically, small antennas, namely that their length L is much less than the wavelength. Taking into account their low electrical dimensions, the efficiency of these antennas is generally poor. This is expressed in the following equation:

$$\eta = \frac{R_{\text{rad}}}{R_{\text{rad}} + R_{ohm}}$$

where $R_{rad}$ is the radiation resistance and $R_{ohm}$ is the ohmic loss resistance.

The invention proposes to improve the efficiency of the antenna by reducing the resistance of the ohmic loss, without modifying the size of the antenna.

Figure 3:
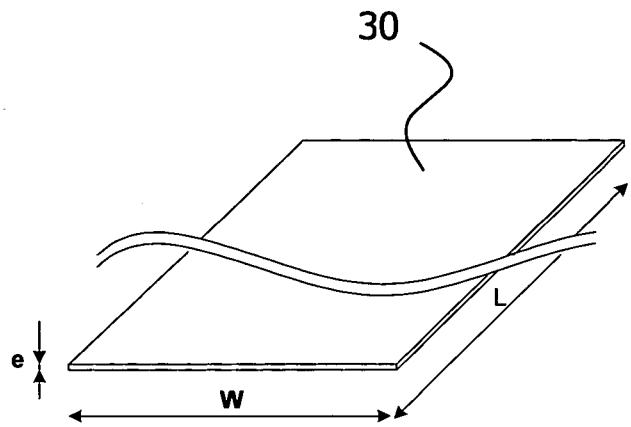
FIG. 3 represents a conducting element as implemented in the invention before folding.

FIG. 3 shows a radiating element 30 before folding according to the invention. This radiating element 30 is a conductive strip of width W, of length L and thickness e. This strip is for example realised in copper.

Figure 4:
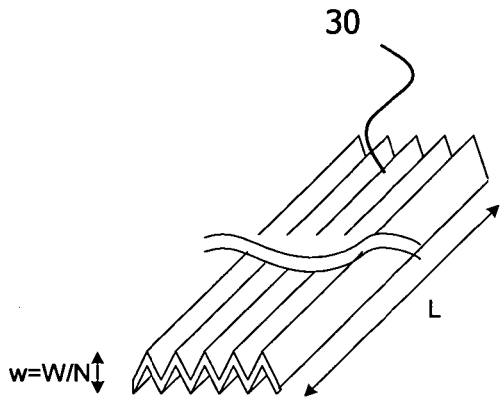
FIG. 4 represents a conducting element as implemented in the invention after folding.

According to the invention, this strip is folded N times like a bellows as shown in FIG. 4.

Finally, in the example of the loop antenna, once the radiating element 30 is folded it is given the form of a loop antenna whose perimeter is then equal to L and the width to w=W/N. The width w can be modified if necessary.

An antenna obtained in this manner according to the invention and thus showing dimensions of perimeter L and width w has a radiation resistance almost identical to that of the standard loop of the size shown in FIG. 1. Indeed, the radiation resistance is mainly determined by the shape and equivalent volume of the antenna.

For example, the antenna can be dimensioned in the following manner W=50 mm; N=10;e=0.1 mm; L=10 cm.

It is known that the current running through a conductive strip of width w and thickness e remains confined in a thin layer dose to the surface having a thickness δ known as skin depth, shown in FIG. 2 and defined by the following equation:

$$\delta = \frac{1}{\sqrt{\pi f \mu \sigma}}$$

where f is the operating frequency in Hz, $\mu=4\pi\times10^{-7}$ H/m, and σ is the conductivity of the material (equal to $5.813\times10^{7}$ S/m for copper).

Hence, for a copper conductor at the frequency of 100 MHz, the skin depth is 6.6 μm. It is noted that the conductive strip must be of thickness e, greater than 2δ. Taking into account the typical values of e and δ, this condition is widely met.

The ohmic loss resistance is thus written as:

$$R_{ohm} = \frac{L}{S_{eff}\sigma}$$

where $S_{eff}$ is the effective conducting surface for the strip, namely $S_{eff}=2(W+e)\delta$.

Figure 5:
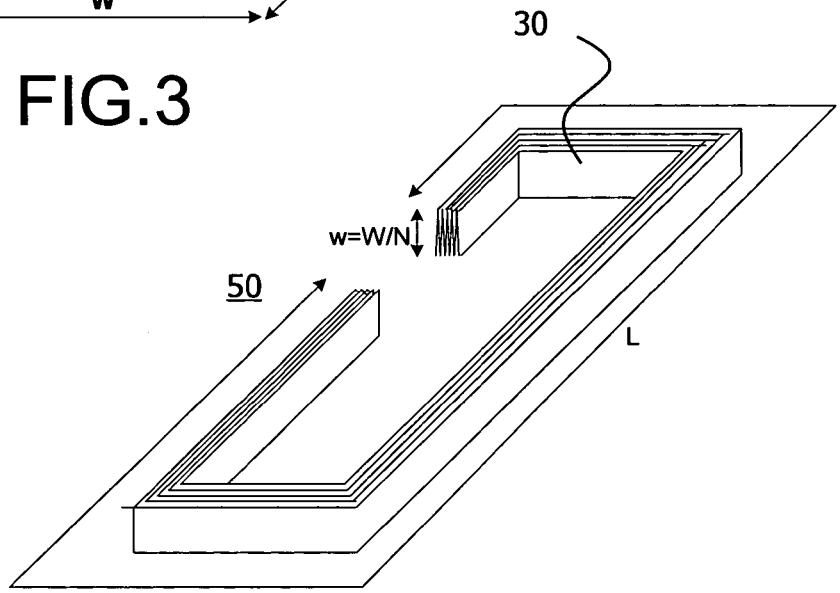
FIG. 5 illustrates a loop antenna according to the invention.

Thus, the ohmic loss resistance is $$(R_{ohm})_5 = \frac{L}{2(W+e)\delta\sigma}$$

for the loop antenna according to the invention, shown in FIG. 5 and $$(R_{ohm})_1 = \frac{L}{2\left(\frac{W}{N}+e\right)\delta\sigma}$$

for the standard loop antenna, represented in FIG. 1.

Therefore, for W>W/N>>e, a condition widely realised for the typical values selected W=500×e and N =10, $$(R_{ohm})_5 \cong \frac{L}{2W\delta\sigma} \text{ and } (R_{ohm})_1 \cong \frac{NL}{2W\delta\sigma}.$$

Hence the equation:

$$(R_{ohm})_5 \cong \frac{(R_{ohm})_1}{N}.$$

So the invention makes it possible to reduce the ohmic loss resistance.

This is useful in the antennas for which the ohmic loss and, if necessary, the dielectric loss is non-negligible, which is the case in small antennas where the efficiency is generally poor.

Hence, for an antenna efficiency in the order of −20 dB, a standard efficiency obtained for a loop type antenna, the reduction of the ohmic loss enables an improvement of the efficiency of the antenna that is almost proportional to the reduction of the ohmic loss.

$$\text{Indeed, } \eta_{dB} = 10\log\eta \text{ implies that } \eta = 0,01 = \frac{1}{1+\frac{R_{ohm}}{R_{rad}}}$$

$$\text{where } 1+\frac{R_{ohm}}{R_{rad}} = 100 \text{ is therefore } 1+\frac{R_{ohm}}{R_{rad}} \approx \frac{R_{ohm}}{R_{rad}} \text{ and } \eta \approx \frac{R_{rad}}{R_{ohm}}.$$

Thus, the antenna efficiency is inversely proportional to the loss resistance $R_{ohm}$. In these conditions, the division of the loss resistance $R_{ohm}$ by a factor of 10 improves the antenna efficiency by 10 dB. This is a very good margin of improvement Hence, the invention significantly improves the efficiency of the small antennas, particularly loop type antennas, while keeping a very low antenna volume.

In an advantageous embodiment, the folding angle is determined so as to adjust the impedance value of the antenna. Hence, the invention improves the impedance matching of the antenna. Indeed, it is known that the impedance presented by a small loop is highly inductive, which makes matching difficult. The folding of the strip introduces a capacitive component that has the effect of reducing the inductive behaviour of the loop and thus making impedance matching easier. The capacitive component can also be adjusted by the folding angle. Indeed, the folding of the metal strip forms V-shaped capacitive elements and one can show by analogy with the known calculation of the capacitance of a capacitor (C=ϵS/e where ϵ is the permittivity of the dielectric, S the surface of the conducting plates and e the thickness of the dielectric) that the capacitance varies with the folding angle (angle between the two metal parts of each V-shape of the folded strip).

Figure 6:
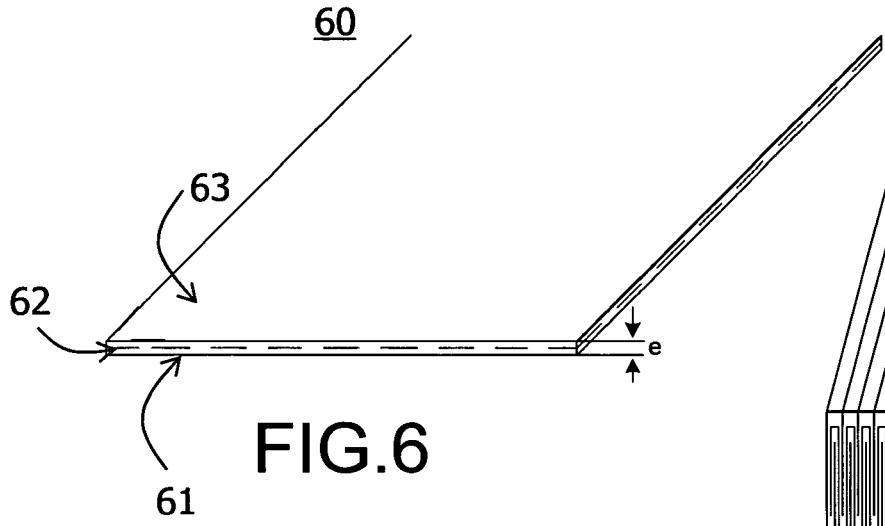
FIG. 6 shows a conducting element in a particular embodiment of the invention before folding.
Figure 7:
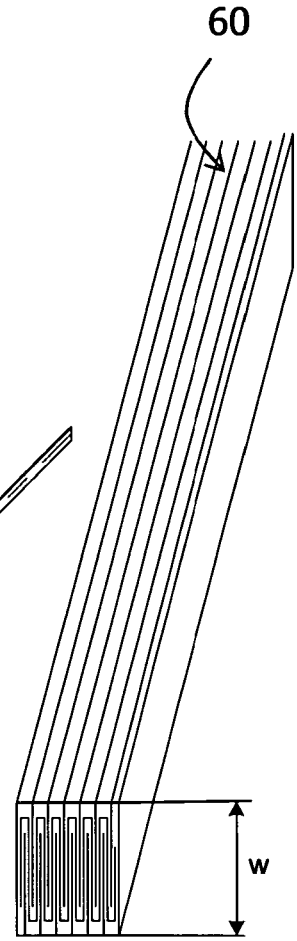
FIG. 7 shows a conducting element in a particular embodiment of the invention after folding.

In an embodiment illustrated by FIGS. 6 and 7, the radiating element 60 uses a substrate 61 in a thin plastic material as a support, for example a flexible polyester film, metallized on one face 62 and possibly covered with another thin layer of dielectric 63. The conductive strip is thus sandwiched between two layers of dielectric film. The thickness e is thus of the order of a few hundred microns. The radiating element 60 thus constituted is then folded according to the invention as shown in the partial view of FIG. 7. Besides the advantages of reduction in the ohmic loss resistance and the ease of realising such an antenna, an increase is observed in the capacitive effect owing to the presence of the dielectric material. Hence, the choice of the support material and more particularly of its dielectric permittivity offers additional flexibility for controlling the capacitive effect and therefore the impedance matching of the antenna. Moreover, it is noted that the materials of the two dielectric layers 61 and 63 can be different and offer still more flexibility.

The invention is not limited to the embodiments described and those skilled in the art will recognise the existence of different embodiment variants such as for example the metal strip can be a strip of thin sheet metal that is folded in a zigzag as shown in the invention, the folding profile, its form, its regularity, its periodicity, the length and profile of the loop that can notably be single or multiple to improve the antenna efficiency.

What is claimed is:

1. A process for manufacturing a band type radiating element comprising the following steps:

folding like a bellows, a conducting sheet of length L and width W, the conducting sheet being folded N times according to the length L, to obtain a band of length L and width w, with w<<W, and, folding said conducting sheet in the form of a loop.

2. The process according to claim 1, wherein the conducting sheet is folded with a folding angle determined so as to adjust the impedance of the antenna.

3. The process according to claim 1, wherein the conducting sheet is made of a thin sheet metal.

4. The process according to claim 1, wherein the conducting sheet is constituted by a metallization layer realised on one face of a substrate made of a thin plastic material.

5. The process according to claim 4, wherein the metallized substrate is covered with a thin dielectric layer.

6. A Band type antenna including a radiating element produced by folding a conducting sheet of length L and width W, like a bellows the conducting sheet being folded N times according to the length L, to obtain a band of length L and width w, with w<<W; and folding said conducting sheet in the form of a loop.

7. The antenna according to claim 6, wherein the radiating element has a length L giving the perimeter of the band and a width w, where w=W/N, W being the initial width of the strip and N the number of folds.

* * * * *